US005709614A

United States Patent [19]

Horiba

[11] Patent Number: 5,709,614

[45] Date of Patent: Jan. 20, 1998

[54] GOLF CLUB HEAD AND METHOD OF MANUFACTURING THE SAME

[75] Inventor: Toshihiro Horiba, Hiratsuka, Japan

[73] Assignee: The Yokohama Rubber Co., Ltd., Tokyo, Japan

[21] Appl. No.: 708,410

[22] Filed: Sep. 5, 1996

[30] Foreign Application Priority Data

Sep. 7, 1995 [JP] Japan ..... 7-230145

[51] Int. Cl.[6] ..... A63B 53/02

[52] U.S. Cl. ..... 473/305; 473/345

[58] Field of Search ..... 473/305, 306, 473/307, 308, 309, 310, 343, 345, 346

[56] References Cited

U.S. PATENT DOCUMENTS

| | | | |
|---|---|---|---|
| 2,462,754 | 2/1949 | Lagerblade et al. | 473/310 |
| 3,625,513 | 12/1971 | Ballmer | 473/310 |
| 5,439,218 | 8/1995 | Gondeck | 473/308 |
| 5,452,890 | 9/1995 | Bingman | 473/346 |
| 5,501,459 | 3/1996 | Endo | 473/346 |
| 5,542,664 | 8/1996 | Mahaffey et al. | 473/305 |
| 5,575,723 | 11/1996 | Take et al. | 473/345 |

*Primary Examiner*—William M. Pierce

*Attorney, Agent, or Firm*—Finnegan, Henderson, Farabow, Garrett & Dunner

[57] ABSTRACT

At a lower end portion of a hole formed in a heel side portion of a hollow metal golf club head and used to fix a golf club shaft therein, a plug member for closing the same hole is provided so that the shaft-fixing hole does not communicate with a hollow portion on the inner side of the club head. This can prevent the entry of extraneous matter into the hollow portion and the occurrence of an imperfect product which makes a sound.

14 Claims, 3 Drawing Sheets

GOLF CLUB HEAD AND METHOD OF MANUFACTURING THE SAME

BACKGROUND OF THE INVENTION

This invention relates to a golf club head, and more particularly to a metal golf club head having a hollow portion therein and capable of preventing the entry of extraneous matter into the hollow portion and the production of imperfect products which make a sound, and a method of manufacturing the same.

In general, a golf club head of a greater volume is less likely to miss hit a golf ball and easier to drive a golf ball. Therefore, in recent years, golf club heads formed out of a metal material, such as aluminum and titanium and proposed very frequently are made hollow at the inner portions thereof so as to increase the dimensions thereof.

Such a metal golf club head is manufactured by welding together into a unitary body a plurality of hollow divisional club heads which are obtained by casting. Accordingly, a golf club shaft fixing hole at a heel side portion of the club head body is formed so as to communicate with the hollow of the club head body. This permits the air expanded in the hollow of the club head body due to the heat occurring during the welding operation to escape from the shaft fixing hole.

A metal golf club head formed into a unitary body by welding is subjected at its shaft fixing hole to a finishing process using a drill in a stage prior to a club shaft connecting stage in a club shaft fixing step. While this shaft fixing hole is processed, chips fall into the hollow portion of the golf club head. If there are unremovable chips, they remain as they are in the hollow portion and cause a sound to be made (an imperfect product to be obtained).

SUMMARY OF THE INVENTION

An object of the present invention is to provide a metal golf club head having a hollow portion therein and capable of preventing the entry of extraneous matter into the hollow portion and the occurrence of an imperfect product which makes a sound, and a method of manufacturing the same.

The golf club head according to the present invention which achieves this object has at a heel side portion of a hollow metal club head body a hole used for fixing a golf club shaft therein, and formed so as to communicate with the hollow portion on the inner side of the club head body, and is characterized in that a plug member for closing the shaft fixing hole is provided in a lower end portion thereof.

The method of manufacturing golf club heads according to the present invention is characterized in that it comprises the steps of welding at least two divisional club head members together so as to form a hollow metal club head body provided with a club shaft fixing hole at a heel side portion thereof so that the shaft fixing hole communicates with the hollow on the inner side of the club head body, and providing a plug member for closing the shaft fixing hole in a lower end portion thereof.

The lower end portion of the shaft fixing hole is thus closed with the plug member so that the shaft fixing hole does not communicate with the hollow of the club head body. Accordingly, even when the shaft fixing hole is subjected to a finishing process using a drill in a stage prior to a club shaft connecting stage in a club shaft fixing step, chips do not enter the hollow of the club head body. After the shaft fixing hole has been subjected to the finishing process, a bonding agent applied to the golf club shaft does not hang down into the hollow of the club head body while the club shaft is inserted into the same hole. Therefore, extraneous matter does not enter the hollow of the club head body, so that the occurrence of an imperfect product which makes a sound can be prevented.

Since the chips do not fall into the hollow of the club head body, it is not necessary to pay attention to the chips occurring during the finishing of the shaft fixing hole, so that this finishing operation can be carried out easily. This enables the efficiency of a club shaft fixing operation to be improved.

Figure 3:
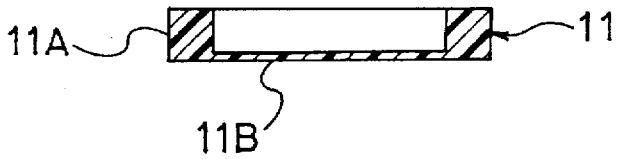
FIG. 3 is an enlarged sectional view showing an example of a plug member.
Figure 7:
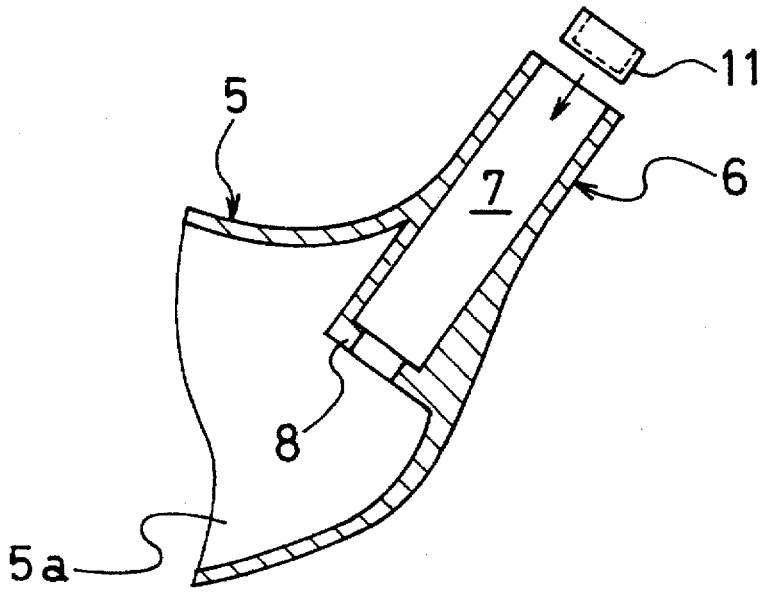
Figure 8:
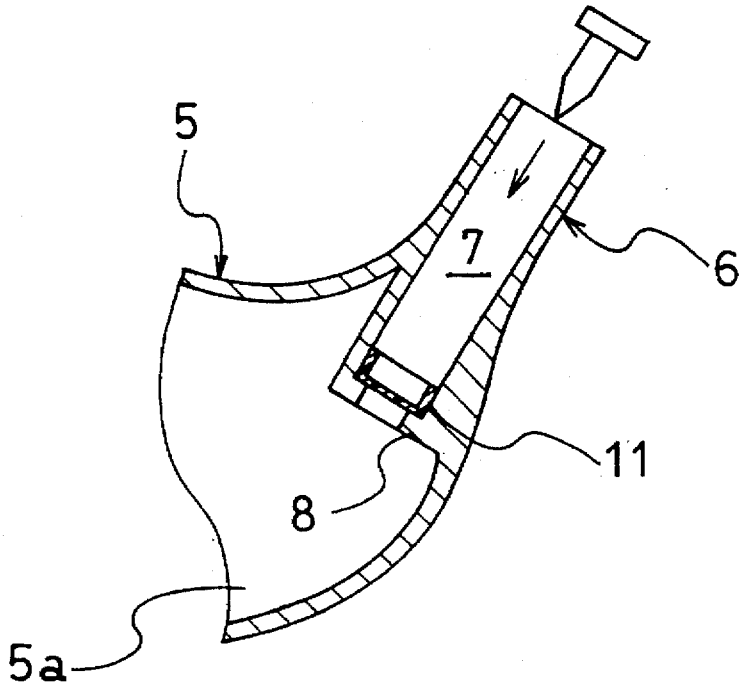

FIG. *6a* is a front view of an upper divisional club head member manufactured by casting;

FIG. *6b* is a front view of a lower divisional club head member manufactured by casting;

FIG. 7 illustrates the step of fixing the plug member of FIG. 3 in a shaft fixing hole in a hosel; and FIG. 8 illustrates the step of fixing a heavy member in the shaft fixing hole in a hosel.

DETAILED DESCRIPTION OF THE PREFERRED EMBODIMENTS

Figure 1:
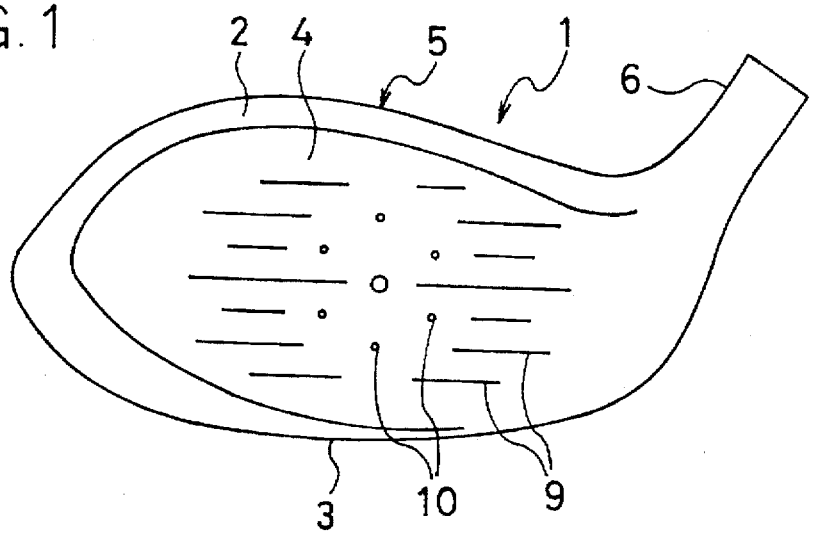
FIG. 1 is a front view showing an example of the golf club head according to the present invention, an example of a wood type golf club head.

As shown in FIG. 1, the golf club head 1 according to the present invention has a head body 5 having a crown 2 at an upper portion thereof, a sole 3 at a lower portion thereof and a ball striking face 4 at its front side and a hosel 6 projecting from a heel side portion of the head body 5 in a diagonally upward direction. The head body 5 and hosel 6 are formed 25 a unitary structure out of the same metal material. The head body 5 is hollow in the interior thereof.

Figure 2:
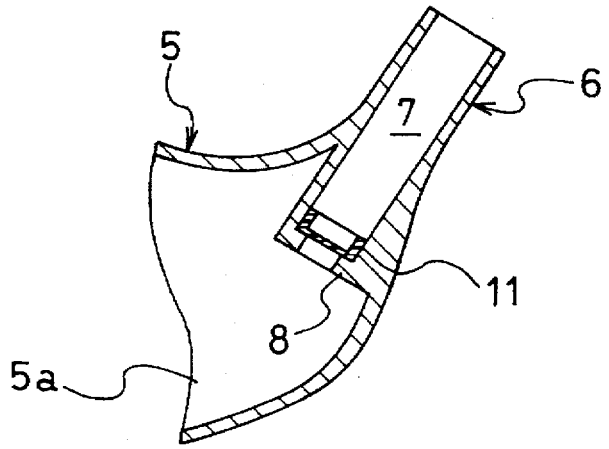
FIG. 2 is a sectional view of a principal portion of the example of FIG. 1.

The hosel 6 is provided as shown in FIG. 2 with a cylindrical hole 7 for inserting a golf club shaft thereinto and fixing the same therein. This shaft fixing hole 7 is formed so as to communicate with a hollow portion *5a* of the head body 5. At a lower end of the shaft fixing hole 7, an annular stopper or ledge 8 projecting in the inward direction of the hole 7 is formed integrally with the wall of the hole 7.

Reference numerals 9, 10 denote a plurality of grooved scoring lines and a plurality of hemispherical dimples respectively which are provided in the face 4.

According to the present invention, a plug member 11 is provided in a lower end portion of the shaft fixing hole 7 in the golf club head 1 of the above-described construction so as to close the same. The plug member 11 is formed with a diameter substantially equal to the inner diameter of the shaft fixing hole 7 and is held in place and fixed on the ledge.

The lower end portion of the shaft fixing hole 7 communicating with the hollow portion *5a* of the head body 5 is thus closed by the plug member 11. Therefore, even when the shaft fixing hole 7 is subjected to a finishing process using a drill in a stage prior to a club shaft connecting stage, chips do not fall into the hollow portion 5*a*. Moreover, after the shaft fixing hole has been subjected to the finishing process, a bonding agent applied to the golf club shaft will not hang down into the hollow portion 5*a* of the head body 5 when the club shaft is inserted into the same hole.

Accordingly, the entry of extraneous matter into the hollow portion 5*a* of the golf club head 1 can be prevented. This enables the occurrence of an imperfect product which makes a sound to be prevented.

Since the chips do not fall into the hollow portion 5*a*, the finishing process for the shaft fixing hole 7 can be carried out speedily without paying attention to the chips occurring during this process. This enables the efficiency of the club shaft fixing operation to be improved.

A metal material for integrally forming the head body 5 and hosel 6 is not specially limited, i.e., a conventionally used metal material can be used. For example, stainless steel, titanium, aluminum, duralumin and the like can preferably be used.

The plug member 11 can be formed out of a synthetic resin material. The resin material used for this purpose may comprise a known resin material as long as it can prevent the entry of extraneous matter into the hollow portion 5*a*, and it is not specially limited. For example, nylon (polyamide), acrylonitrile butadiene styrene copolymer (ABS), polyacetal, polypropylene and so on which have suitable levels of rigidity, thermal resistance and flexibility can preferably be used.

Figure 4:
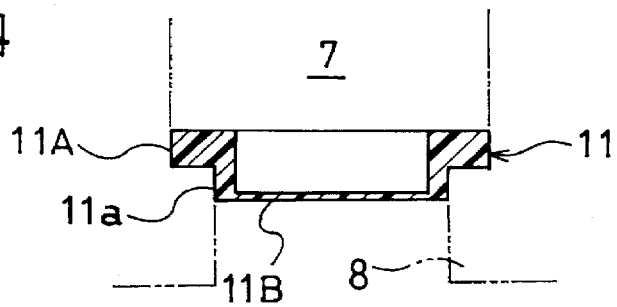
FIG. 4 is an enlarged sectional view showing another example of a plug member.

The shape of the plug member 11 can be set, for example, as shown in FIGS. 3 and 4. The plug member 11 shown in FIG. 3 is formed so that an outer circumferential portion thereof has a large thickness and is designated as a large-thickness portion 11A. The portion of this plug member which is on the inner side of the large-thickness portion 11A, i.e. a central portion is formed with a smaller thickness and is designated as a small-thickness portion 11B. The plug member of FIG. 4 is formed by providing such a plug member 11 as shown in FIG. 3 with a cross-sectionally right-angled recessed portion 11*a* at a lower part of a large-thickness portion 11A thereof. This recessed portion 11*a* is formed so as to be engaged with the ledge 8. The plug member 11, the central portion of which is thus formed as a small-thickness portion 11B, can be used specially preferably when a heavy member shown in FIG. 5 and to be described later is fixed therein.

Figure 5:
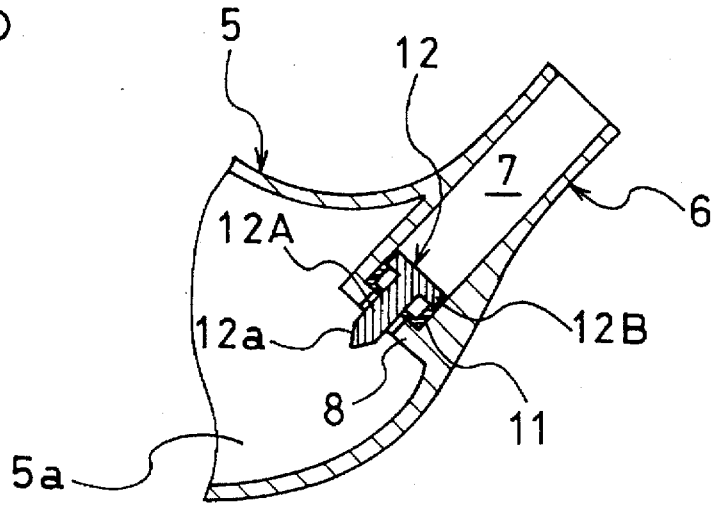
FIG. 5 is a sectional view showing a principal portion of another example of the golf club head according to the present invention.

FIG. 5 shows a club head provided with a heavy member 12 in addition to a plug member 11 referred to above. This heavy member 12 has a projecting portion 12A extending through a small-thickness portion 11B of the plug member 11 and projecting into a hollow portion 5*a* of a head body 5. A head portion 12B of the heavy member 12 is formed to a diameter which is larger than that of the projecting portion 12A. The head portion 12B is formed so as to be engaged with an upper surface of the large-thickness portion 11A of the plug member 11 when the heavy member 12 is fixed. The projecting portion 12A is provided on a lower end of the head portion 12B. A lower end part 12*a* of the projecting portion 12A is formed conically at an acute angle so that the lower end part can break the small-thickness portion 11B of the plug member 11 and enter the interior of a hollow portion 5*a* easily.

The heavy member 12 is fixed by engaging the head portion 12B thereof with the upper surface of the large-thickness portion 11A of the plug member 11, and passing the projecting portion 12A through the small-thickness portion 11B of the plug member 11 so as to project into the hollow portion 5*a* of the head body 5. Since the heavy member 12 is extended into the interior of the hollow portion 5*a*, the center of gravity of the metal golf club head 1 can be lowered. If the dimensions of the projecting portion 12A and head portion 12B of the heavy member 12 are regulated, the weight of the golf club head 1 and the balance of a shaft-fixed golf club can be regulated.

A material used for the heavy member 12 is not specially limited as long as it works as a weight. It can preferably comprise, for example, brass and tungsten.

The metal golf club head of the above-described construction can be manufactured, for example, in the following manner.

Figure 6A:
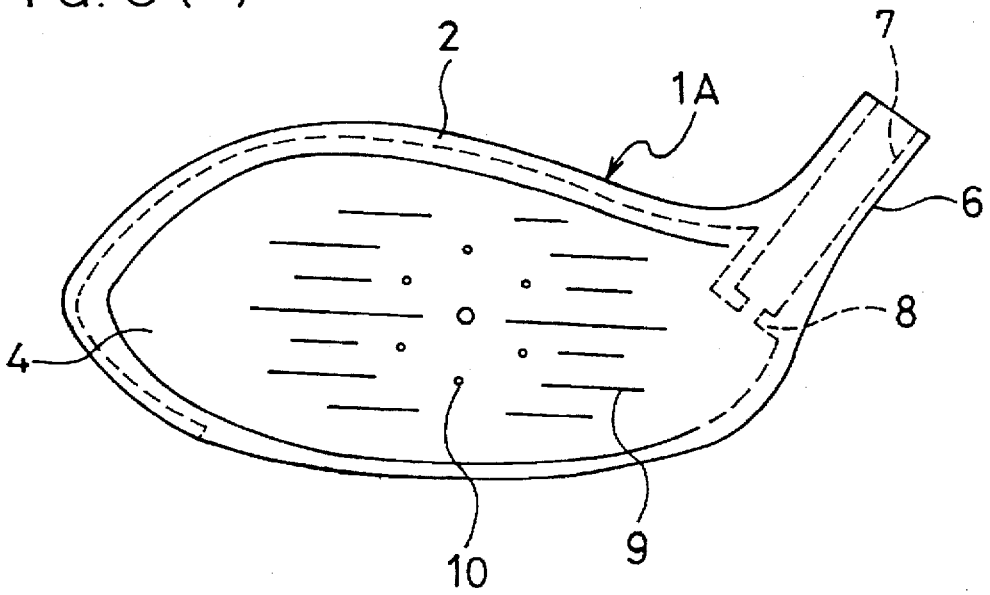
Figure 6B:
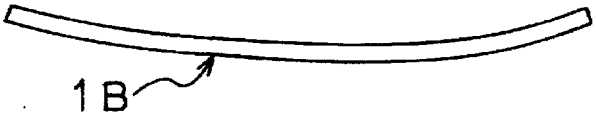

First, a main divisional head member 1A and a subsidiary divisional head member (sole plate) 1B, two complementary parts of a golf club head shown in FIGS. 6*a* and 6*b*, are manufactured by casting using molds (not shown). The main divisional head member 1A has a crown 2, a face 4 and a hosel 6, and a shaft-fixing hole 7 is formed in the hosel 6. An annular ledge 8 projecting in the inward direction of the hole 7 is provided at a lower end of and integrally with the wall of the same hole. The face of the main divisional head member 1A is provided with scoring lines 9 and dimples 10.

The main divisional head portion 1A and sole plate 1B are then joined together fixedly by welding. Consequently, a hollow metal head body 5 having a hosel 6 formed at a heel side portion thereof and integrally therewith, and a club shaft-fixing hole 7 formed in the hosel 6 so as to communicate with the inner portion of the head body can be obtained.

The plug member 11 is then inserted into the shaft fixing hole 7 as shown in FIG. 7 before the surface of this metal head body 5 has been finished by polishing. The plug member 11 is forced into the shaft-fixing hole 7 up to the lower end portion thereof and fixed on the upper surface of the ledge 8, whereby the golf club head of FIG. 1 can be obtained. The plug member 11 may be coated with a small quantity of bonding agent and fixed on the ledge.

In case of setting the heavy member 12, as shown in FIG. 8 the plug member 11 is fixed in the shaft-fixing hole 7 and the heavy member 12 is inserted thereinto. The plug member 11 is then forced into the hole 7 up to the lower end thereof. Since the lower end portion 12*a* of the heavy member 12 is formed conically at an acute angle, it breaks through the small-thickness portion 11B of the plug member 11, and the projecting portion 12A extends into the hollow portion 5*a* of the head body 5 with the head portion 12B of the heavy member 12 engaging the upper surface of the plug member 11, whereby the heavy member 12 is fixed in the shaft-fixing hole 7. Thus, the golf club head of FIG. 5 is obtained.

In this example of the golf club head manufacturing method according to the present invention, the golf club head is divided horizontally into two, which are the main divisional head member 1A and sole plate 1B but, instead of this example, an example in which a golf club head is manufactured by welding two vertically divided parts, i.e. front and rear divisional head members may be employed. Instead of the example in which two divisional head members are welded, an example in which three or not less than three divisional head members are welded may also be employed, and any golf club head manufacturing method in which at least two divisional head members are welded may be used.

In these examples of golf club head manufacturing methods, the divisional head members are obtained by casting. The divisional head members can also be obtained by forging or pressing instead of casting.

In these embodiments of the present invention, a golf club head having a hosel 6 projecting from a heel side portion of the head body 5 is described. Instead of such a golf club head, a golf head provided with a shaft fixing hole 7 at the heel side portion of the head body 5 without providing a hosel 6 at the mentioned portion may also be produced The present invention can be used preferably, especially, for the manufacturing of a wood type golf club head.

According to the present invention described above, a plug member for closing the shaft-fixing hole is provided in a lower end portion of the same hole which communicates with the hollow portion of the head body. Therefore, even when the shaft-fixing hole is subjected to a finishing process using a drill in a stage prior to a club shaft connecting stage, chips do not enter the hollow portion of the head body. When the golf club shaft is inserted into the shaft-fixing hole after this hole has been subjected to a finishing process, a bonding agent is applied to the club shaft. This bonding agent does not hang down into the hollow portion. Since the entry of extraneous matter into the hollow portion of the golf club head does not occur, the production of an imperfect club head which make a sound can be prevented.

What is claimed is:

1. In a golf club head having a metal club head body formed of at least two separate metal members that have been secured together by welding and having a hollow interior and a through hole therein in a heel side portion of the body that communicates with said hollow interior and into which is to be fixed a golf club shaft, the improvement comprising a separate plug member located in a lower end portion of the shaft-fixing hole that closes off the hole from the hollow interior of the club head body.

2. The golf club head of claim 1, wherein a ledge is integral with and projects inwardly from an inside surface of a wall of said shaft-fixing hole adjacent a lower end of said hole, said plug member being fixed in place on said ledge.

3. The golf club head of claim 2, wherein the shaft fixing hole and plug member are circular and the ledge on which the plug member is fixed is annular.

4. The golf club head of claim 2, wherein said plug member is made of a synthetic resin material.

5. The golf club head of claim 4, wherein a central portion of said plug member has a reduced small-thickness portion, and said club head includes a heavy member located in said shaft-fixing hole and having a projection that passes through said small-thickness portion of the plug member and into the hollow interior of said head body.

6. The golf club head of claim 5, wherein said heavy member has a head portion having a diameter larger than a diameter of said projection, said projection extending downwardly from a lower end of said head portion and having a conical shape on a lower end part thereof so that the conical end can break through the small-thickness portion of the plug member when the heavy member is inserted into the shaft-fixing hole.

7. The golf club head of claim 1, wherein said golf club head is a wood type golf club head.

8. A method of manufacturing a golf club head, comprising the steps of welding together at least two separate club head members to form a hollow metal club head body having a hollow interior with a club shaft fixing through hole at a heel side portion thereof that communicates with said hollow interior to permit expanded air generated during the welding step to escape from said hollow interior through said shaft fixing hole and thereafter, inserting a plug member into said shaft-fixing hole to close off said shaft-fixing hole in a lower end portion thereof from said hollow interior.

9. The method of manufacturing a golf club head of claim 8, wherein said club head body has at a lower end of said shaft-fixing hole an integral ledge extending inwardly from an inside surface of a wall of said hole on which said plug member is fixed too close off said hole.

10. The method of manufacturing a golf club head of claim 9, wherein said plug member is made of a synthetic resin material.

11. The method of manufacturing a golf club head of claim 10, wherein a central portion of said plug member has a reduced small-thickness portion, and including the further step of inserting a heavy member having projection on a lower end thereof into said hole so that said projection passes through the small-thickness portion and into said hollow interior of said head body.

12. The method of manufacturing a golf club head of claim 11, wherein said heavy member has a head portion having a diameter larger than a diameter of said projection, said projection extending downwardly from a lower end of said head portion and having a conical shape on a lower end part thereof so that the conical end can break through the small-thickness portion of the plug member when the heavy member is inserted into the shaft-fixing hole.

13. The method of manufacturing a golf club head of claim 8, wherein said golf club head is a hosel-carrying club head body with the shaft-fixing hole being located in said hosel and at least two separate head members comprise a main head member and a sole plate.

14. The method of manufacturing a golf club head of claim 8, wherein said golf club head is a wood type golf club head.

* * * * *